US005336146A

United States Patent [19]

Piaget et al.

[11] Patent Number: 5,336,146

[45] Date of Patent: Aug. 9, 1994

[54] TREADMILL WITH DUAL RECIPROCATING TREADS

[76] Inventors: Gary D. Piaget, 1435 W. Silvermeadows Dr. #48; Trace O. Gordon, 3880 W. Lariat Rd., both of Park City, Utah 84060

[21] Appl. No.: 168,025

[22] Filed: Dec. 15, 1993

[51] Int. Cl.[5] ..... A63B 22/04; A63B 22/00

[52] U.S. Cl. ..... 482/54; 482/52; 482/51

[58] Field of Search ..... 482/51, 52, 53, 54

[56] References Cited

U.S. PATENT DOCUMENTS 4,204,673 5/1980 Speer, Sr. .
4,938,473 7/1990 Lee et al. .
5,071,115 12/1991 Welch ..... 482/53
5,114,388 5/1992 Trulaske .
5,160,302 11/1992 Li ..... 482/51

*Primary Examiner*—Stephen R. Crow
*Attorney, Agent, or Firm*—Salter & Michaelson

[57] ABSTRACT

A treadmill device includes a frame, and two side-by-side treadmills each having a continuous tread and first and second ends. The first ends of the two treadmills are pivotably supported on a base portion of the frame by a roller shaft which extends through the treadmill rollers. The second ends of the treadmills are independently supported by spring return hydraulic cylinders which are connected between the treadmills and spaced support members of the frame. The continuous treads are driven by a motor which is coupled to the roller shaft. The treadmills alternately pivot up and down as a user walks thereon.

13 Claims, 2 Drawing Sheets

TREADMILL WITH DUAL RECIPROCATING TREADS

BACKGROUND AND SUMMARY OF THE INVENTION

The instant invention relates to exercise apparatus and more particularly to a treadmill having two side-by-side treads which reciprocate up and down during use thereby providing the benefits of both walking and stair climbing.

Treadmill-type walking apparatus and stair climbing apparatus have heretofore been known in the art. In this connection, the U.S. Patents to Speer, Ser. No. 4,204,673; Lee et al No. 4,938,473; and Trulaske No. 5,114,388 represent the closest prior art to the subject invention of which the applicant is aware. The patent to Speer St. discloses a treadmill having dual treads which are independently operated to provide a separate control of speed and/or resistance for each leg. The tread platforms are stationary and do not move relative to each other. The patent to Lee et al concerns a treadmill having a trampoline-like surface. The Lee treadmill includes a continuous tread which is supported at the peripheral edges by a plurality of springs. The spring-supported tread is resilient enough to absorb shock and rigid enough to provide a stable exercising surface. There are no rigid supporting surfaces beneath the tread. The Patent to Trulaske discloses a stair exerciser including pivotable stair platforms. The stair platforms reciprocate up and down as the user alternately steps up with each foot.

The instant invention provides a treadmill apparatus having dual treads which pivot up and down. Briefly, the treadmill comprises a frame, and two side-by-side treadmills each having a continuous tread and first and second ends. The first ends of the two treadmills are pivotably supported on a base of the frame by a roller shaft which extends through the treadmill rollers. The second ends of the treadmills are independently supported by spring-return hydraulic cylinders which are connected between the treadmills and spaced support members of the frame. The continuous treads are driven by a motor which is coupled to the roller shaft. The two treadmills alternately pivot up and down about the axis of the roller shaft as a user treads thereon. In this manner, the instant treadmill apparatus is operative for providing the aerobic benefits of both walking and stair climbing.

Accordingly, it is an object of the instant invention to provide an exercise device which offers the benefits of both walking and stair climbing.

It is another object to provide a treadmill having dual treads.

It is still another object to provide a treadmill 18 having dual reciprocating treads.

It is yet another object to provide a treadmill having two side-by-side treads which are pivotably mounted to a frame at one end thereof.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
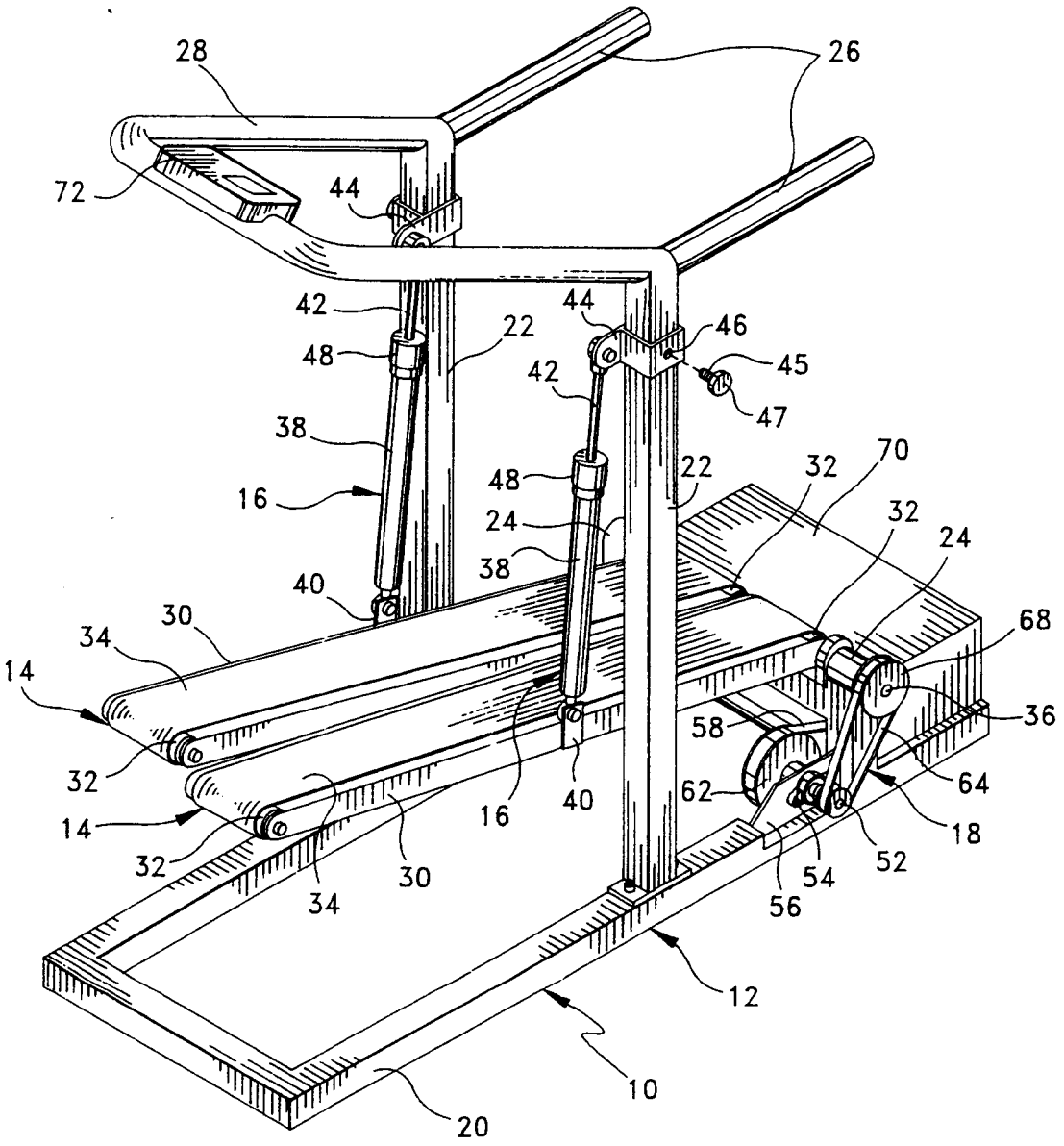
FIG. 1 is a perspective view of the instant treadmill apparatus.

Referring now to the drawings, the treadmill of the instant invention is illustrated and generally indicated at 10 in FIG. 1. As will hereinafter be more fully described, the instant treadmill apparatus 10 includes dual reciprocating treads which effectively provide the benefits of both walking and stair climbing simultaneously. The treadmill apparatus 10 comprises a frame generally indicated at 12, first and second side-by-side treadmills generally indicated at 14, first and second spring-return hydraulic cylinders generally indicated at 16, and a drive mechanism generally indicated at 18.

The frame 12 is preferably constructed from tubular steel, and it preferably comprises a rectangular base 20 and two spaced support members 22 which extend upwardly from a central portion of the base 20. The base 20 includes two spaced upright arms 24 which are positioned adjacent one end thereof. The support members 22 each include a handlebar 26 which extends rearwardly from the support member 22, and the support members 22 still further include a U-shaped handle bar 28 which extends forwardly therefrom.

Figure 2:
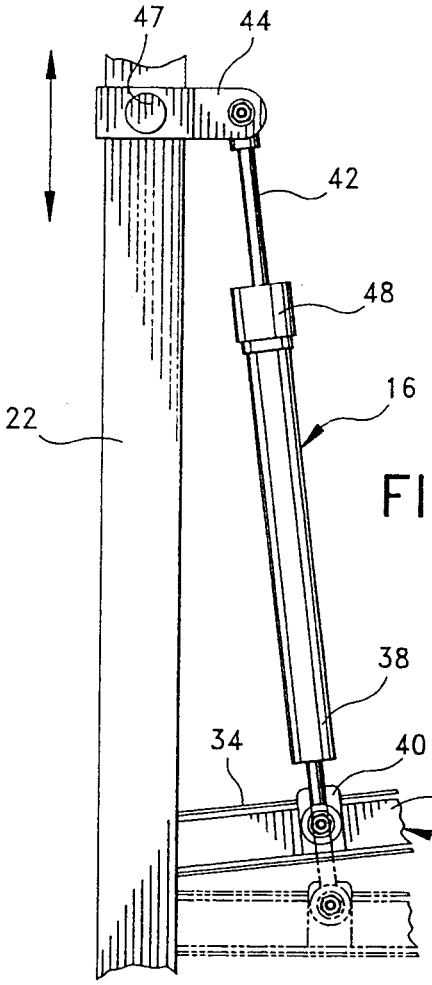
FIG. 2 is a fragmentary side view of one of the spring-return hydraulic cylinders.

The two treadmills 14 are identical in construction, and they each preferably comprise a rigid treadmill platform 30, rollers 32 rotatably mounted at each of the first and second ends of the platform 30, and a continuous tread 34 which extends around the platform 30 and is rotatably supported by the rollers 32. The construction of the treadmills 14 is considered to be conventional in the art, and therefore no further description is thought to be necessary. The treadmills 14 are pivotably mounted to the frame 12 in side-by-side adjacent relation by an elongated roller shaft 36 which extends through the rollers 32 at the first ends of the treadmills 14, and through the upright arms 24 on the base 20. More specifically, the roller shaft 36 is rotatably received through bearings (not shown) mounted in the upright arms 24. In this regard, it can be seen that the treadmills 14 pivot upwardly and downwardly about the axis of the roller shaft 36. It is pointed out that the roller shaft 36 is keyed to the rollers 32 for corresponding rotation thereof. The second ends of the treadmills 14 are supported in an inclined position by the spring-return hydraulic cylinders 16. The spring-return hydraulic cylinders 16 are conventional in the art, and they preferably each comprise a body 38 which is connected to a flange 40 on the outer side of the treadmill platform 30, a rod 42 which is connected to a tubular flange 44 on the spaced support member 22, and a coiled return spring (not shown) which is mounted inside the body 38. The flanges 44 are moveable up and down the length of the support members 22 for adjusting the angle of inclination of the treadmills. In this connection, the flanges 44 further include a set screw 45 which extends through a threaded aperture 46 in the flange 44 and engages with the support member 22 for setting a position of the treadmill 14. The set screw 45 includes an enlarged knob 47 to facilitate rotation of the set screw 45. Alternatively, the flanges 44 can be adjustable by means of a series of holes in the support members 22 and a set pin which extends through the flange 44 and one of the holes. The hydraulic cylinder 16 provides resistance against extension of the rod 42, and the return spring operates to return the rod 42 to its original position after extension. In this connection, the coil spring supports the treadmill 14 in a first normal inclined position (solid lines in FIG. 2) while the hydraulic cylinder 16 resists downward pivoting movement of the treadmill 14 from the first position to a second position (broken lines in FIG. 2) when a user places his weight thereon. The coil spring then returns the treadmill 14 from the second position back to the first position when the user removes his weight from the treadmill 14. The hydraulic cylinders 16 each include a rotatable adjustment cap 48 which is operative for adjusting the resistance of the hydraulic cylinder 16.

It is contemplated that the spring-return hydraulic cylinders 16 can be replaced by a torsion spring which is received around the roller shaft 36. The torsion spring would be adjustable to provide variable resistance to downward movement of the treadmills 14. It is further contemplated that the internal return springs of the hydraulic cylinders 16 could alternatively comprise external rubber bands which extend between the treadmills 14 and the support members 22. In this connection, the device would include a conventional hydraulic cylinders to resist downward movement of the treadmills 14 and rubber bands to return the treadmills 14 to their original position. It is pointed out that each of the spring return mechanisms must be strong enough to return the treadmills 14 to their original position before the user again steps thereon, yet they should not be so strong as to immediately snap the treadmills 14 back into position. In this connection, the hydraulic cylinders 16 provide some resistance during the return of the treadmills 14 so that the upward and downward pivoting of the treadmills occurs in a smooth transition.

Figure 3:
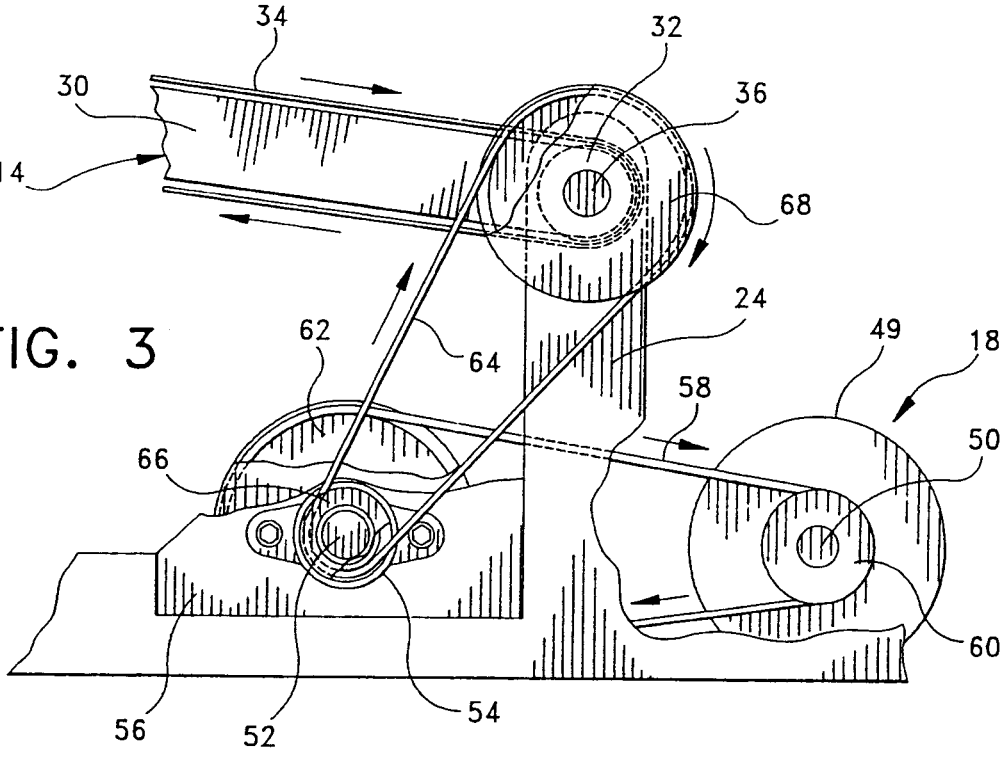
FIG. 3 is a fragmentary side view of the drive mechanism for the treads.

The drive mechanism 18 comprises an electric motor 48 (FIG. 3) which is mounted to the base 20 of the frame 12. The motor 49 includes a rotatable drive shaft 50 which is coupled to the roller shaft 36 by means of a belt and pulley transmission. The belt and pulley transmission includes a transmission shaft 52 which is rotatably captured in a bearing 54 which is mounted to a flange 56 on the base 20 of the frame 12. The drive shaft 50 is coupled to the transmission shaft 52 by a first belt 58 which extends around a pulley 60 on the drive shaft 50 and a pulley 62 on a first end of the transmission shaft 52. The transmission shaft 52 is coupled to the roller shaft 36 by a second belt 64 which extends around a pulley 66 on the second end of the transmission shaft 52 and a pulley 68 on an exposed end of the roller shaft 36. In operation, rotation of the drive shaft 50 causes rotation of the transmission shaft 52 which in turn causes rotation of the roller shaft 36, the rollers 32 and the continuous treads 34. Since both treadmills 14 are driven by a common roller shaft 36, the continuous treads 34 are driven at the same speed.

The base 20 of the frame 12 preferably includes rigid housing 70 which encloses the electric motor 48 and which also functions as a step or platform from which a user can step onto and off of the treadmills 14.

In operation, a user stands with one leg positioned on each of the side-by-side treadmills 14, and then walks on the treadmills 14 at a pace equal to the speed of the continuous treads 34, i.e. in the same manner as a conventional treadmill. As the user alternates his steps and transfers his weight back and forth between the two treadmills 14, the treadmills 14 alternately pivot up and down against the resistance of the hydraulic cylinders 16. More specifically, when the user steps forward with one foot onto the inclined end of the respective treadmill 14, the treadmill 14 pivots downwardly about the axis of the roller shaft 36 against the resistance of the respective hydraulic cylinder 16. Thereafter, the rotating tread 34 moves the user's foot rearwardly toward the first end of the treadmill 14 until the user steps forward with the opposite foot onto the inclined end of the opposite treadmill 14 wherein the second treadmill 14 pivots downwardly and the first treadmill 14 is returned upwardly to its original position by the return spring. Accordingly, it can be seen that as a user treads upon the treadmills 14, they alternately reciprocate up and down in a manner similar to a stair climbing device.

The treadmill apparatus 10 is further provided with an electronic control and monitoring device 72 which is operative for controlling motor speed, and for measuring and displaying time, horizontal distance travelled, vertical distance travelled, calories burned, heart rate, and other exercise variables. It is contemplated that the electronic control device 72 can include a graphical display which graphically charts the average inclination being travelled by the user by extrapolating the horizontal and vertical distances travelled. The control device 72 is preferably mounted on the U-shaped handle bar 28 so that it is readily accessible to the user during operation of the treadmill 10.

While the preferred embodiment of the treadmill device 10 includes a motor 48 for driving the treads 34, the device 10 may also comprise an unmotorized embodiment in which the inclined treadmills 14 are driven by gravity and the weight of the user as the user's feet alternatively step onto the treadmill 14.

It can therefore be seen that the instant invention provides an exercise device 10 which is effective for simultaneously providing the exercise benefits of both a conventional treadmill and a stair climbing apparatus. The treadmill apparatus 10 includes dual side-by-side treadmills 14 which operate in a conventional manner to simulate walking. In addition, the dual treadmills 14 pivot up and down as a user treads thereon to simultaneously simulate climbing stairs. The exercise device 10 is simple in design, and construction, and it is inexpensive to manufacture. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. Treadmill apparatus comprising:

first and second adjacent treadmills each having a continuous tread, and first and second ends;

a frame pivotably supporting the first ends of said first and second treadmills;

first and second spring means for supporting the respective second ends of said first and second treadmills in a first position above a supporting surface; and first and second resistance means for resisting downward pivoting movement of said first and second treadmills from said first position to a second position as a user's weight is placed upon said treadmills, said first and second spring means returning said first and second treadmills from said second position to said first position when said user's weight is removed from said first and second treadmills, said first and second treadmills alternately pivoting up and down about said first ends as a user treads thereon.

2. The treadmill apparatus of claim 1 further comprising means for driving said continuous treads.

3. In the treadmill apparatus of claim 2, said first and second treadmills having rollers at said first and second ends for rotatably supporting said continuous treads, said first ends of said first and second treadmills being pivotably supported on said frame about an axis of said rollers.

4. The treadmill apparatus of claim 3 further comprising an elongated roller shaft which passes through said rollers at said first ends of said first and second treadmills, said roller shaft being rotatably supported on said frame means.

5. In the treadmill apparatus of claim 4, said drive means comprising a motor having a rotatable drive shaft and transmission means for transmitting rotation of said motor drive shaft to said roller shaft for rotation of said rollers and said continuous treads.

6. In the treadmill apparatus of claim 1, said first and second resistance means comprising first and second hydraulic cylinders which are connected between said frame and said first and second treadmills.

7. In the treadmill apparatus of claim 1, said first and second treadmills having rigid treadmill platforms for supporting said continuous treads thereon, said first and second resistance means comprising first and second hydraulic cylinders which are connected between said frame and said treadmill platforms.

8. In the treadmill apparatus of claim 6, said frame including a base and two spaced support members which extend upwardly from said base, said first and second hydraulic cylinders being connected between said spaced support members and said treadmill platforms.

9. In the treadmill apparatus of claim 1, said first and second spring means and said first and second resistance means comprising first and second spring return hydraulic cylinders which are connected between said frame means and said first and second treadmills.

10. The treadmill apparatus of claim 5 further comprising control means for controlling operation of said motor.

11. The treadmill apparatus of claim 1 further comprising electronic monitoring means for monitoring time, horizontal distance travelled and vertical distance travelled.

12. In the treadmill apparatus of claim 11, said monitoring means including a graphical display for graphically charting an average inclination being travelled by a user.

13. In the treadmill apparatus of claim 8, said first and second hydraulic cylinders each having a first end which is connected to a first flange on said treadmill platforms and a second end which is connected to a second flange on said spaced support members, said second flange being adjustably moveable on said support member for adjusting an inclination of said treadmill.

* * * * *